US010106292B2

(12) United States Patent
Al-Khal et al.

(10) Patent No.: US 10,106,292 B2
(45) Date of Patent: Oct. 23, 2018

(54) SYSTEM OF PACKAGING AND DISPLAYING A SET OF PRODUCTS

(71) Applicant: Lutron Electronics Co., Inc., Coopersburg, PA (US)

(72) Inventors: Adam Ghosoub Al-Khal, Allentown, PA (US); Benjamin F. Bard, Zionsville, PA (US); David S. Bennett, Bethlehem, PA (US); Jason C. Killo, Emmaus, PA (US)

(73) Assignee: Lutron Electronics Co., Inc., Coopersburg, PA (US)

( * ) Notice: Subject to any disclaimer, the term of this patent is extended or adjusted under 35 U.S.C. 154(b) by 0 days.

(21) Appl. No.: 15/609,773

(22) Filed: May 31, 2017

(65) Prior Publication Data

US 2017/0341805 A1 Nov. 30, 2017

Related U.S. Application Data

(60) Provisional application No. 62/343,360, filed on May 31, 2016.

(51) Int. Cl.

| | |
|---|---|
| ***B65D 5/52*** | (2006.01) |
| ***A47F 7/28*** | (2006.01) |
| ***B65D 5/50*** | (2006.01) |
| ***B65D 5/00*** | (2006.01) |
| ***A47F 7/03*** | (2006.01) |

(52) U.S. Cl.

CPC ..... *B65D 5/5213* (2013.01); *A47F 7/283* (2013.01); *B65D 5/0085* (2013.01); *B65D 5/50* (2013.01); *A47F 7/03* (2013.01)

(58) Field of Classification Search

CPC ..... B65D 5/5213; B65D 5/50; B65D 5/0085; A47F 7/283; A47F 7/03

USPC ..... 206/775, 776, 472, 461–471, 736–774, 206/278, 291, 293

See application file for complete search history.

(56) References Cited

U.S. PATENT DOCUMENTS

| | | | | |
|---|---|---|---|---|
| 2,126,407 A * | 8/1938 | Payne | B65D 5/0085 | 206/472 |
| 3,595,382 A * | 7/1971 | Hofer | B65D 5/4204 | 206/215 |
| 3,670,881 A * | 6/1972 | Dutcher | B65D 5/248 | 229/125.015 |
| 4,146,128 A * | 3/1979 | Hogg | B65D 5/5088 | 206/318 |

(Continued)

*Primary Examiner* — Chun Cheung

(74) *Attorney, Agent, or Firm* — Glen Farbanish; Amy Yanek; Philip Smith

(57) ABSTRACT

A system of packaging and displaying a set of products is disclosed. The system may include a first and second container, together forming a hinged box, each container including a first display face, and a first back positioned on a side of the container opposite the first display face. A first magnetic element and a second element magnetically responsive to the first magnetic element may be positioned in the containers to assist in closing the box. At least one of the containers includes a transparent cover that secures, even in the open position of the box, displayed products, the displayed product visible through the cover when the box is hinged open. The cover has perforations that can be torn to access the products without tools. The products are arranged in the order of use and installation.

19 Claims, 16 Drawing Sheets

(56) References Cited

U.S. PATENT DOCUMENTS

| | | | | | |
|---|---|---|---|---|---|
| 4,739,353 | A * | 4/1988 | Heuer | B65D 85/38 | 206/316.1 |
| 4,789,061 | A * | 12/1988 | Roze | G11B 23/0236 | 206/387.13 |
| 4,823,950 | A * | 4/1989 | Roze | G11B 33/045 | 206/308.1 |
| D329,601 | S * | 9/1992 | Samelson | D9/721 | |
| 5,582,293 | A * | 12/1996 | Kay | B65D 5/4204 | 206/457 |
| 6,471,060 | B1 * | 10/2002 | Leyshon | A63H 3/50 | 206/472 |
| 6,527,123 | B1 * | 3/2003 | Ausaf | A47J 47/14 | 206/541 |
| 6,739,453 | B1 * | 5/2004 | Mazurek | B65D 5/321 | 206/461 |
| 6,758,340 | B1 * | 7/2004 | Feibelman | B65D 5/4204 | 206/474 |
| 7,494,015 | B2 * | 2/2009 | Bacon | B65D 5/4204 | 206/320 |
| 8,028,836 | B2 * | 10/2011 | Bacon | B65D 5/0045 | 206/386 |
| 8,177,060 | B2 * | 5/2012 | Kim | B65D 85/18 | 190/34 |
| 8,322,526 | B2 * | 12/2012 | Kim | B65D 85/182 | 206/278 |
| 2005/0173286 | A1 * | 8/2005 | Hansen | B65D 77/006 | 206/472 |
| 2014/0262863 | A1 * | 9/2014 | Fournier | B65D 85/68 | 206/223 |

* cited by examiner

SYSTEM OF PACKAGING AND DISPLAYING A SET OF PRODUCTS

CROSS REFERENCES TO RELATED APPLICATIONS

This application claims the benefit of U.S. Provisional Patent Application No. 62/343,360, filed May 31, 2016, entitled SYSTEM OF PACKAGING AND DISPLAYING A SET OF PRODUCTS, the entire disclosure of which is incorporated by reference herein.

BACKGROUND OF THE INVENTION

Field of the Invention

The present invention relates to packaging and containers for products and, more particularly, to packaging for a set of related electronic products that can store, organize, and display the products.

Related Art

A variety of product packaging types, including retail product packaging, cartons, containers, and shrink-wrapping for electronic devices are known. When a kit or a set of related electronic products are sold in a retail environment, the packaging must protect the set of products but also provide an attractive retail profile.

SUMMARY OF THE INVENTION

Disclosed are an article of manufacture and a system of packaging and displaying a set of products with, for example, the products being arranged in an order of use and installation of the products. Such a system may include a box having a first container and a second container. The first container may include first display face, and a first back positioned on a side of the container opposite the first display face. The second container may include a second display face, and a second back positioned on a side of the second container opposite the second display face. The first and second containers may be hingedly connected to allow the box to change from a closed position to an open position. The first and second display faces may be oriented to be open toward a first direction in the open position. The system may further comprise a cover configured to close off the first display face of the first container and to secure in the first container a displayed product of the set of products. The displayed product may be visible through the cover. The cover may comprise a first side portion for securing the cover in the first container and at least one tear perforation may be positioned more proximal to the display face than the first side portion. The cover may comprise a grasping portion that may include at least one of a finger tab on the cover and a recess area. The grasping portion may be configured to be manually grasped and pulled, and the at least one tear perforation may be configured to be torn, when the grasping portion is manually pulled, so as to provide access without tools to the displayed products.

One of the first and second containers may include a first magnetic element, and another of the first and second containers may include a second element positioned and configured to be magnetically attracted to the first magnetic element. The first magnetic element and the second element may assist closure of the box to the closed position.

The cover may include a center portion having a deployed position in which the center portion faces toward the first direction, and the side portion may be configured to be positioned, when the cover is in a deployed position, to be transverse to a plane of a major surface of the center portion and to be inserted in the at least one of the first and second container. The center portion of the cover may include a material different from a remaining material of the cover, and the center portion may provide some transparency to visible light.

Also, the first and second containers may each comprise an insert having four sides, the insert configured to be positioned immediately inside the respective container. The first and second containers may each include an insert having four sides, and the first magnetic element and the second element are positioned in the inserts. The at least one tear perforation may have a first tear perforation and a second tear perforation without perforated connection to the first tear perforation. The second container may comprises a second cover configured to secure in the second container a second displayed product of the set of products and to close off the second display face. The second displayed product may be visible through the cover.

The second cover may comprise a second side portion for securing the second cover in the second container. The second cover may also comprise at least one tear perforations positioned more proximal to the display face than the second side portion, and a grasping portion comprising at least one of a finger tab on the cover and a recess area. The grasping portion may be configured to be manually grasped and pulled, and the at least one tear perforation may be configured to be torn when the grasping portion is manually pulled, so as to provide access without tools to the displayed product in the second container. The at least one tear perforation of the second cover may comprise a first tear perforation and a second tear perforation without perforated connection to the first tear perforation.

The first and second container may each comprise a side portion positioned transverse to the display face and configured to support the respective container in a standing position transverse to a lying position in which the respective container rests on the back of the container. Each side portion may have at least one notch sized and configured to hold at least one of the first magnetic element and the second element.

In such a system, the first or second container may include a first strap having an aperture and configured to secure in the first container a protruding product of the set of products. The protruding product may have a portion protruding through the aperture and the strap may comprise a first catch received in the first container and securing the first strap and the protruding product in the first container; at least one tear perforation positioned more proximal to the first display face than the first catch; and a grasping portion comprising at least one of a finger tab protruding from the strap and a recess area. The grasping portion may be configured to be manually grasped and pulled, and the at least one tear perforation may be configured to be torn, when the grasping portion is manually pulled, so as to release the protruding product without tools. The at least one tear perforation of the first strap may have a first tear perforation and a second tear perforation without perforated connection to the first tear perforation. The first catch may include a first tab and second tab oriented away from the first tab. The first and second tab may be received and anchored in the same aperture. The first strap may also include a second catch that comprises a third tab and a fourth tab oriented away from the third tab. The third tab may be oriented in substantially the same direction as the first tab and the fourth tab may be oriented in substantially the same direction as the second tab. The third tab and fourth tab may project from side of the first strap opposite the first tab and the second tab, and may be positioned and configured to secure the first strap.

The second catch may include a third tab and a fourth tab oriented in substantially the same direction as the third tab. The third tab may be oriented in a substantially the same direction as the first tab. The first strap may further comprise a top area positioned between the first and second tear perforations and made of a first material. A remainder of the first strap is made of a second material different from the first material. The first material may be transparent or translucent. A second strap identical to the first strap may also be included to secure a second protruding product of the set of products.

An anchoring insert having apertures configured to receive the catches of the first strap and to secure thereby the first strap and the protruding product may also be included in the system. When a second strap identical to the first strap is included, the anchoring insert may have additional apertures configured to receive catches of the second strap. The anchoring insert may have a recess configured to receive a portion of a second electronic product.

In the open position, when placed on the first and second backs, the first container and the second container may lie flat and the first and second display faces face up.

One of the first and second containers may include a lip protruding toward the first direction, and another of the first and second containers may include a recessed edge positioned such that in the closed position, the recessed edge and lip cooperate to facilitate securement of the box in a closed condition. The lip and edge may be provided in the inserts that are positioned immediately inside the containers. The first container may have outer dimensions substantially equal to the dimensions of the second container, exclusive of the lip.

The first and second containers may be configured to arrange the set of products such that a first product of the set of products designed to be deployed in use by a user ahead of all remaining products of the set of products is accessible first by the user in the first and second containers, and a second product of the set of products designed to be deployed in use by a user after the first product is positioned adjacent the first product with no intervening products positioned between the first and second products.

The system may also include a strap member comprising a first catch member and a second catch member oriented away from the first catch member. The first and second catch members may secure the strap member in one of the first container and the second container. The strap may also comprise at least one tear perforation positioned more proximal to the display face than the first and second catch members; and a grasping portion comprising at least one of a finger tab protruding from the strap member and a recess area. The grasping portion may be configured to be manually grasped and pulled, and the at least one tear perforation may be configured to be torn, when the grasping portion is manually pulled, so as to release without use of tools an electronic device of the set of products.

In such a system, the strap member may include a center portion configured to face toward the first direction in the deployed position; and a side portion configured to be positioned, when the cover is in the deployed position, to be transverse to a plane of a major surface of the center portion. The center portion of the strap member may comprise a material different from a remaining material of the strap member, the center portion providing at least some transparency to visible light.

Also, one of the first and second containers may include an anchoring insert having apertures configured to receive the catch members of the strap member, such that the strap member and the anchoring insert cooperate to secure therebetween the electronic device. The anchoring insert may have a recess configured to receive a further electronic device.

A utility box that houses or stores an electronic accessory device may also be included. The utility box may have at least one tear perforation.

This summary is intended only as an introduction to some features of the system but may not be exhaustive of the inventive aspects of the disclosure.

BRIEF DESCRIPTION OF THE DRAWINGS

The foregoing summary, as well as the following detailed description of the preferred embodiments, is better understood when read in conjunction with the appended drawings. For the purposes of illustrating the invention, there is shown in the drawings an embodiment that is presently preferred, in which like numerals represent similar parts throughout the several views of the drawings, it being understood, however, that the invention is not limited to the specific methods and instrumentalities disclosed.

DETAILED DESCRIPTION

Figure 1:
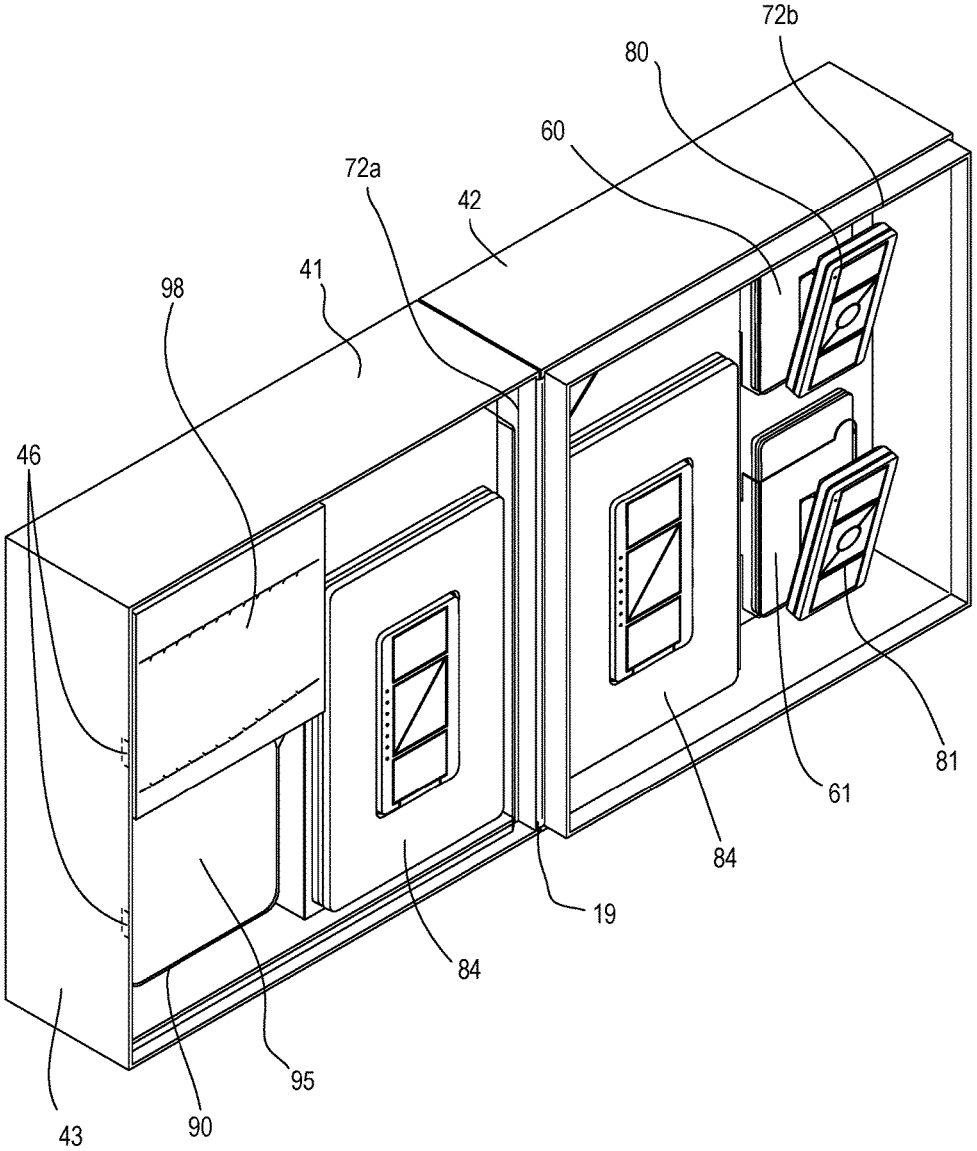
FIG. 1 is a perspective view of an example of a system of packaging and displaying a set of products in an open, displaying position.
Figure 2:
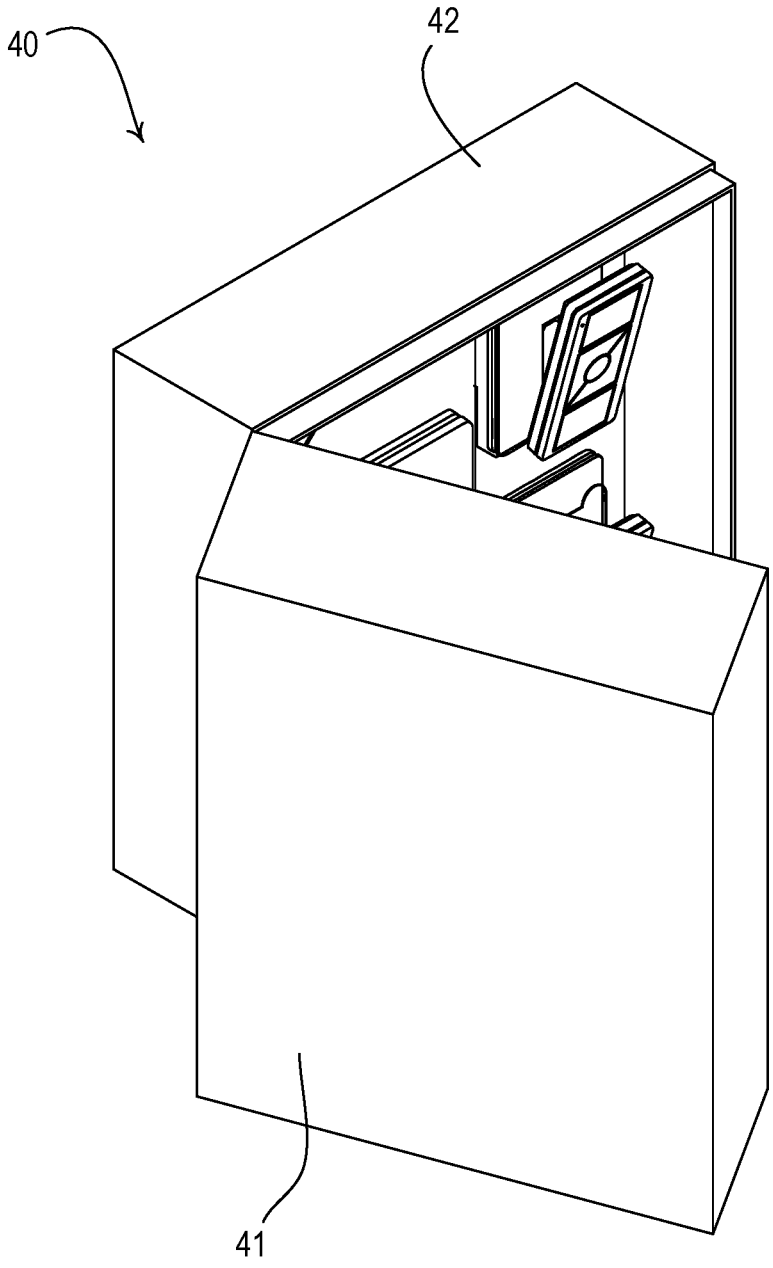
FIG. 2 is a perspective view of the system of packaging and displaying products of FIG. 1 in a semi-closed position.
Figure 3:
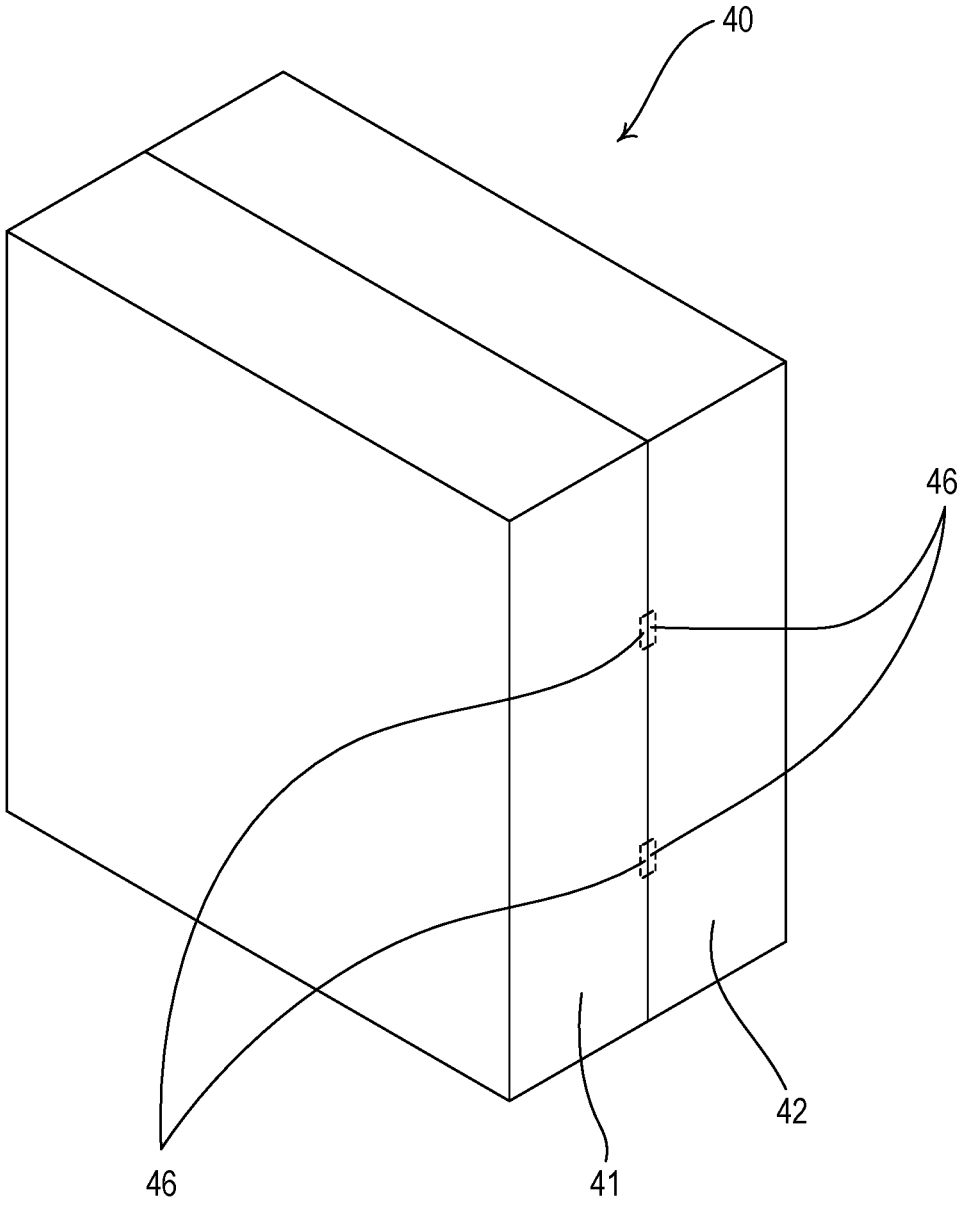
FIG. 3 is a perspective view of the system of packaging and displaying products of FIG. 1 in a closed position thus forming a closed protective box for the set of products.

FIGS. 1-6 illustrate major components of a packaging system (e.g., a box 40) for presenting and housing a set of products, for example, a kit or a set of related electronic products, according to an aspect of the disclosure. The box 40 may be opened to showcase the electronic products (as shown in FIG. 1) and closed when located on a merchandising shelf to present the products for sale (as shown in FIG. 3). The box 40 may comprise first and second containers 41, 42 that may be coupled together by an integral hinge 19, to be described later. Each of the first and second containers 41, 42 may hold and display one or more electronic devices. In the example shown, the electronic devices may comprise control devices of a load control system, for example, wirelessly-controlled load control devices (e.g., dimmer switches) controlled by remote control devices (e.g., hand-held remote controls). The load control system may further include a wireless bridge for allowing control of the dimmer switches via a network device (e.g., a smartphone) via a network (e.g., a cellular phone network and/or the Internet). An example of such a system of related products is described in co-pending United States patent application publication No. 2015/0185752, published Jul. 2, 2015, U.S. Ser. No. 14/578,602, filed Dec. 22, 2014, entitled WIRELESS LOAD CONTROL SYSTEM, the entire contents of which are incorporated by reference herein.

Figure 5:
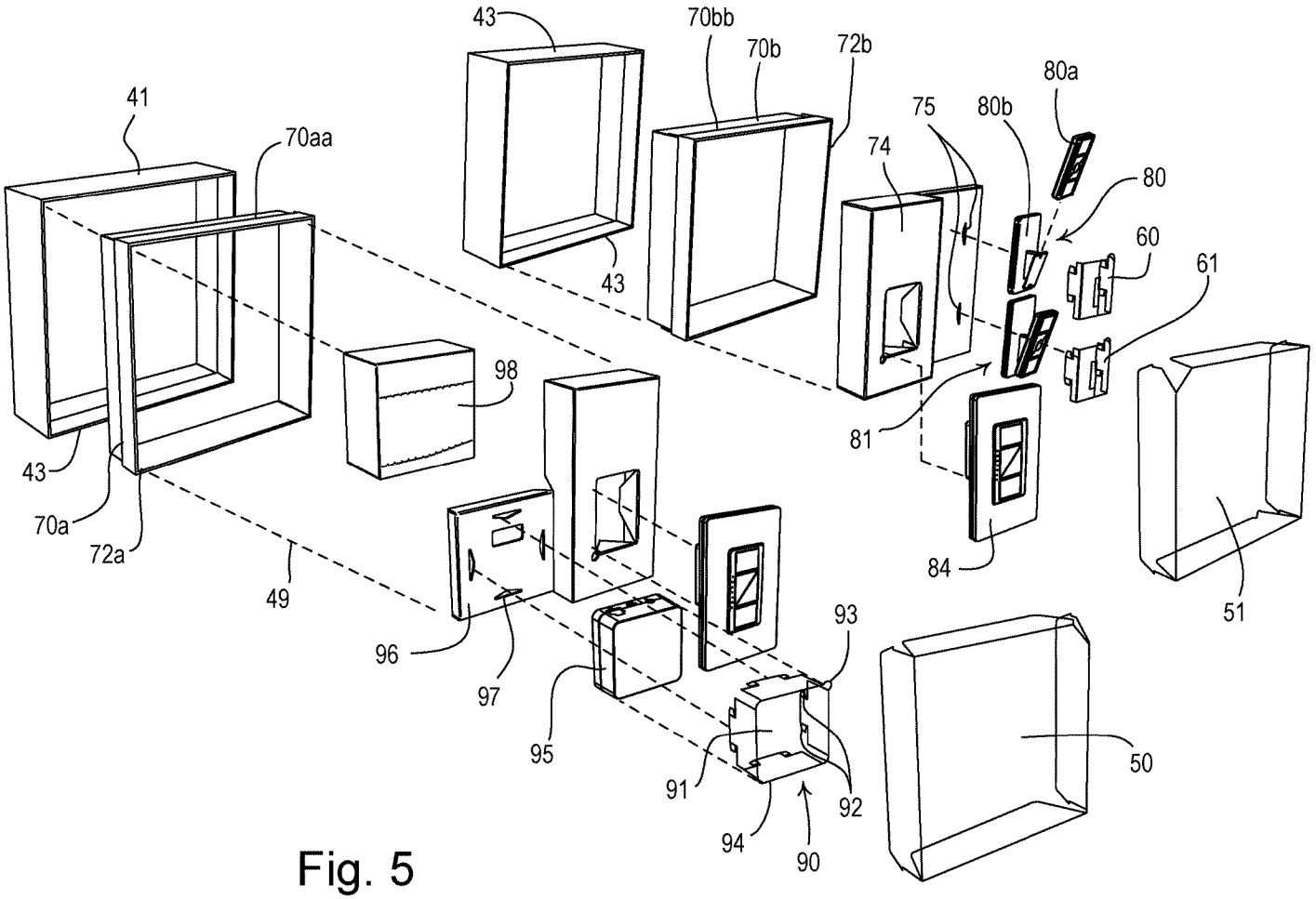
FIG. 5 is an exploded view of the system of packaging and displaying products of FIG. 1.

The box 40 (as shown in FIGS. 1 and 5) may include two dimmer switches 84, a wireless bridge 95, and one or more remote control devices 80, 81. The box 40 may further include accessories for the load control system in a utility box 98, which may include, for example, cables, power cords, plugs, batteries, chargers, instruction manuals and other product literature, and the like, and additional wrapping, cardboard, bubble wrap, flocking or the like. Although described with respect to a set of electronic devices for use by a retail or end user, and in particular to an assembly of electronic devices that may include a wireless control device of a lighting system and remote control devices for controlling the devices as well as a network bridge, other types of electronic devices, as well as other types of products, may be housed in the packaging and displaying system.

Figure 4:
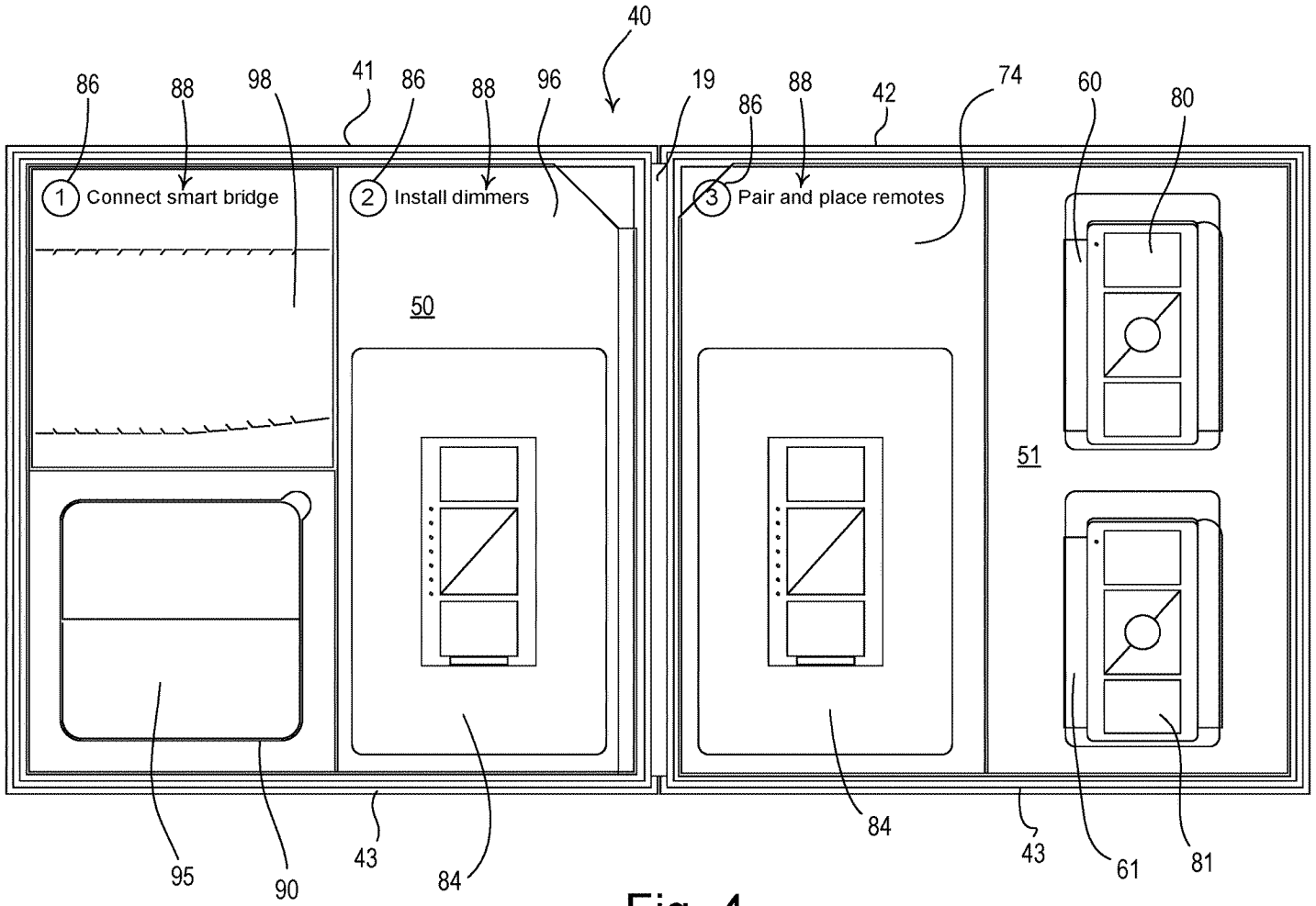
FIG. 4 is a front plan view of the system of packaging and displaying products of FIG. 1 in the open, displaying position.

As illustrated in FIG. 3, the first and second containers 41, 42 may have a closed position in which they form the box 40. The containers 41, 42 may be hinged at an adjoining line by the hinge 19. In the disclosed embodiment, the hinge 19 may be formed by a paper overwrap at the hinge line, which may be suitably strengthened by a strengthening material such as a fabric or cording. In an embodiment, the containers 41, 42 (as well as other parts of the packaging) may be wrapped in a covering material, such as paper, that may be imprinted with identifying information describing and/or showing the products. This overwrap material may be adhered to the container base material (e.g., cardboard or cardstock) and used to form the hinge 19 (e.g., as illustrated in FIGS. 1 and 4). Other packaging, such as shrink wrapping, may be provided around or within the box 40, and the box 40 may be shipped inside or together with other similar boxes, as part of a carton or container, or the like.

When the box 40 is in a fully opened position revealing the contents of the containers 41, 42 (as shown in FIGS. 1 and 4), the first container 41 may present a first display face and the second container 42 presents a second display face. In the fully opened position, the containers 41, 42 may be oriented to lie on their backsides. Backsides as used herein means the side opposite the front face or display face of the containers 41, 42 from which contents of the containers 41, 42 can be viewed. In this fully open position, the containers 41, 42 may lie on a flat surface, such as on a shelf or display table or the like while revealing contents to customers or allowing a user to install the devices contained therein. The containers 41, 42 may also be able to rest on a side surface 43 of each of the containers 41, 42 so that the products contained inside the containers 41, 42 are oriented vertically with respect to the surface on which the containers 41, 42 rest. In this way, the containers 41, 42 may provide a second display position for their contents in which the containers 41, 42 are each positioned to rest on one of their sides 43. Thus, the containers 41, 42 provide several functionalities, including securing, housing, safely transporting and storing the products contained therein in the closed position, organizing the products in a manner logical and useful to the end user or customer for purposes of installation of the products, and displaying the products when the containers 41, 42 stand on one of their sides 43 and when the containers 41, 42 lie in the open position illustrated in FIG. 4.

As illustrated in FIG. 1, a lip 72*b* may be provided on one or more sides, or on all four sides of one of the containers 42 to mate with, nest or cooperate with recessed edge 72*a* of the other container 41 to facilitate the closed position of the box 40 illustrated in FIG. 3. The lip 72*b* may slide inside the container 41, and the lip 72*b* and the container 41 may provide a degree of elastic deformation so as to resist to some extent opening of the box.

The box 40 may also comprise inserts 70*b* and 70*a* (e.g., as illustrated in FIGS. 1 and 2, 8A-8B, and 9A-9B) that may form the lip 72*b* and the recessed edge 72*a*, respectively. However, the lip 72*b* and the recessed edge 72*a*, or at least one of them, may be provided on the containers 41, 42. The lip 72*b* may be provided on one or more sides, or on all four sides, of the insert 70*b* or of the container 42. More than one such lip may be provided. Also, the lip 72*b* may be provided on the container 41 or on the insert 70*a* thereof, and the recessed edge 72*a* may be provided on the container 42 or on the insert 70*b* thereof.

The inserts 70*a* and 70*b* may be sized such that their outermost extents fit or nest snugly within the inner extents of the respective containers 41, 42. Alternatively, only the insert 70*b* with the lip 72*b* may be provided, and the insert 70*a* may be unnecessary. However, the provision of both inserts 70*a*, 70*b* may provide for added structural rigidity of the box 40. As shown, the inserts 70*a*, 70*b* may be provided with an adhesively-secured overwrap (e.g., as shown by the lines 70*aa*, 70*bb*) for ornamental, decorative, and/or aesthetic purposes. The overwrap may only be provided where it is exposed to view to conserve overwrap material, and the overwrap material may be paper or made of other materials. The inserts 70*a*, 70*b*, like the containers 41, 42, may be cardboard or cardstock or any other suitable packaging materials.

One or more magnets 46, such as a magnetized magnetic element, may be provided in a side of the containers 41, 42 and a second element, such as a ferrous magnetically responsive element such as steel or iron magnetically responsive to the first magnetic element, may be provided in the other of containers 41, 42. In this way, the box 40 when closed may tend to resist opening without deliberate human intervention because of the attractive force of the magnet and the magnet-responsive second element positioned in the side of the containers 41, 42.

Figure 7A:
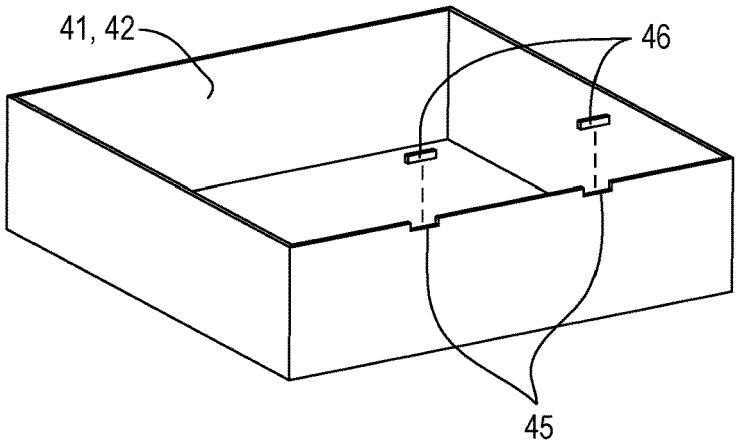
FIG. 7A is a perspective view of an example of a first or second container for a system of packaging and displaying a set of products.
Figure 7B:
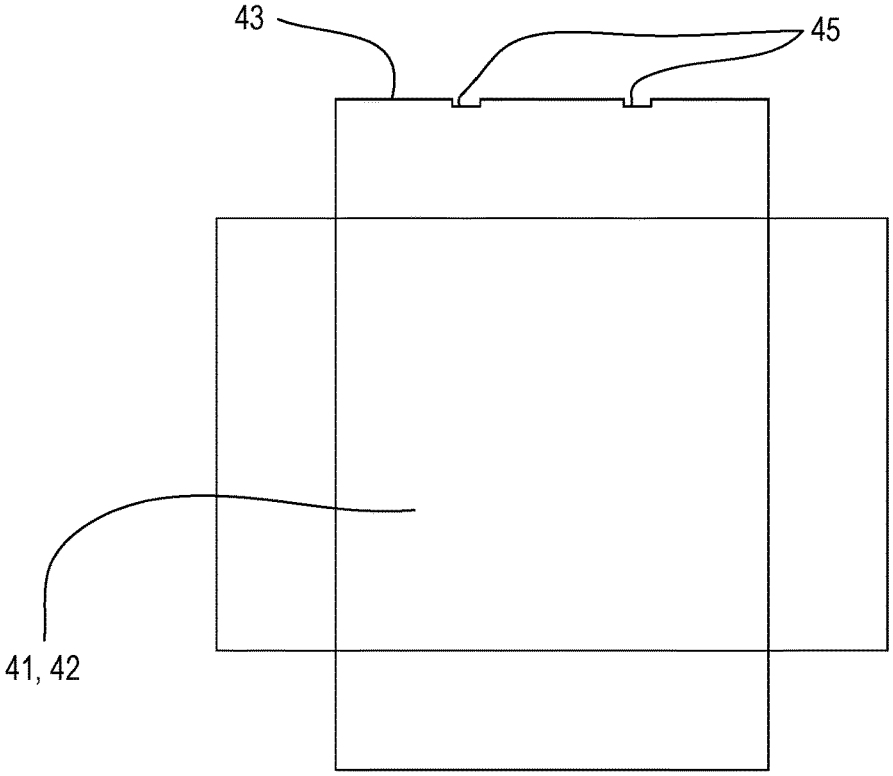
FIG. 7B is an illustration of an example of the first or second container in the unfolded position.
Figure 8A:
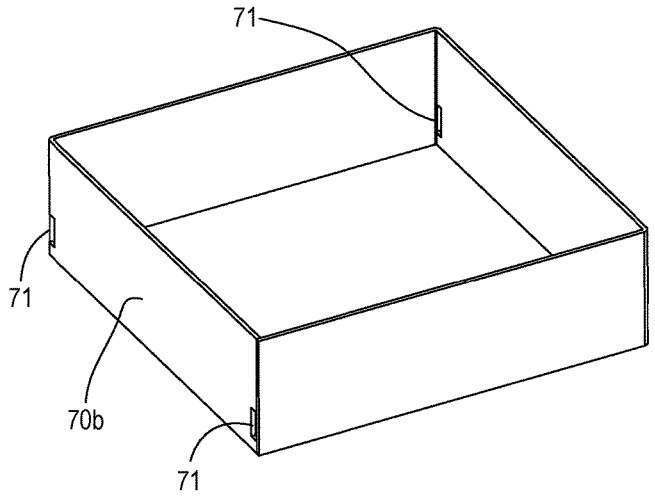
FIG. 8A is a perspective view of an example of an insert for the second container that is part of a system of packaging and displaying a set of products.
Figure 8B:
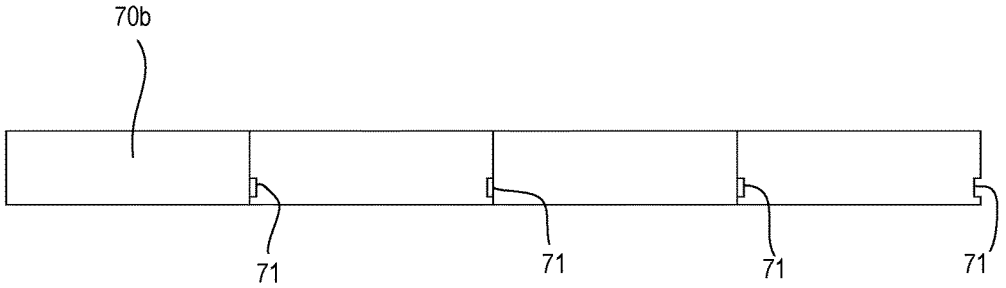
FIG. 8B is an illustration of an example of the insert of FIG. 8A in the unfolded position.
Figure 9A:
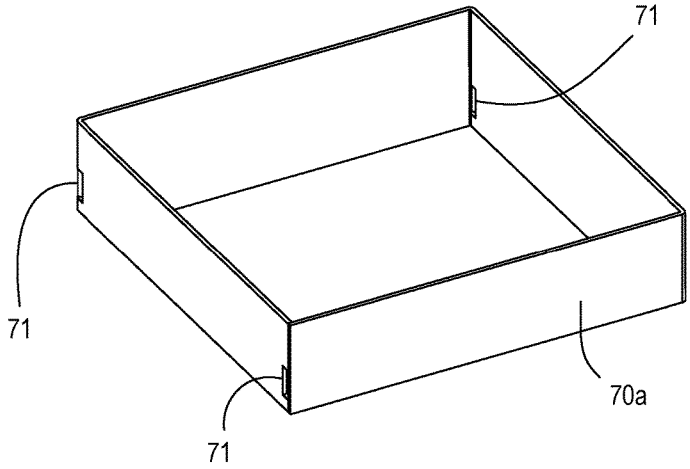
FIG. 9A is a perspective view of an example of an insert for the first container that is part of a system of packaging and displaying a set of products.
Figure 9B:
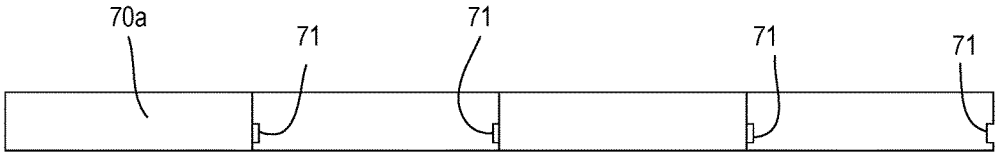
FIG. 9B is a view of an example of the insert of FIG. 9B in the unfolded position.

The containers 41, 42 may have slots 45 that may receive the magnets 46 to facilitate closing as shown in FIG. 7A. While shown as two slots 45, one or more slots may be provided in each of the containers 41, 42. The number of slots of the container 41 may be different from the number of slots provided in the container 42. For example, a length of the magnet may be different from the length of the second element, and thus a different number of slots may be correspondingly provided. Also, such slots and the magnets/metallic second elements may be provided on other portions of the system, for example, on the inserts 70*a*, 70*b*, or one set may be provided on the side of one of the containers 41, 42 while the cooperating set may be provided on another portion, such as on the inserts 70*a*, 70*b*.

Figure 15A:
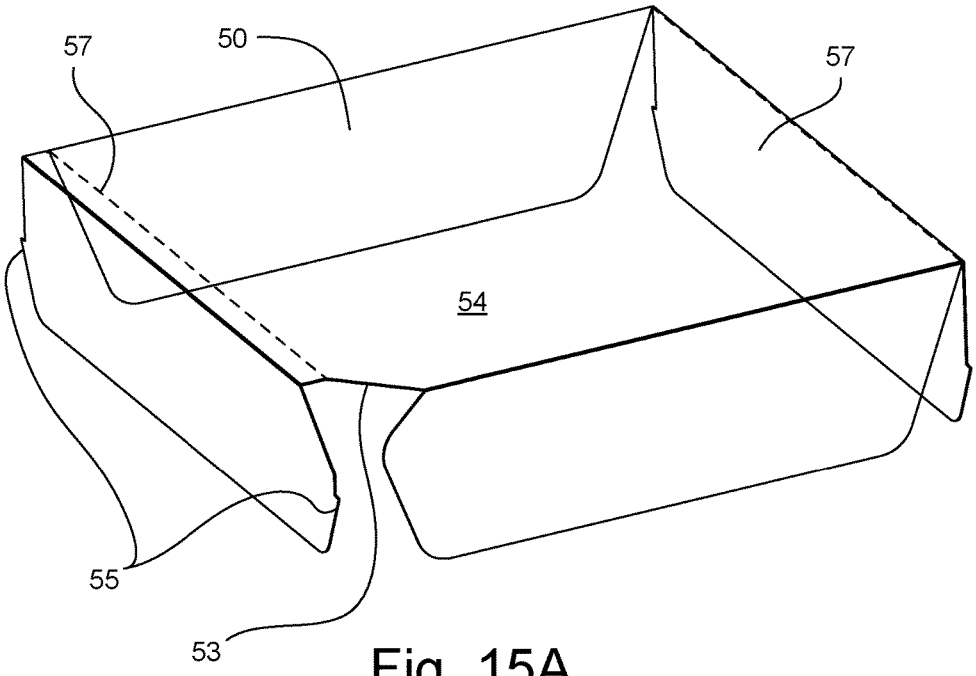
FIG. 15A is a perspective view of an example of a first transparent cover that may be provided as part of a system of packaging and displaying a set of products.
Figure 15B:
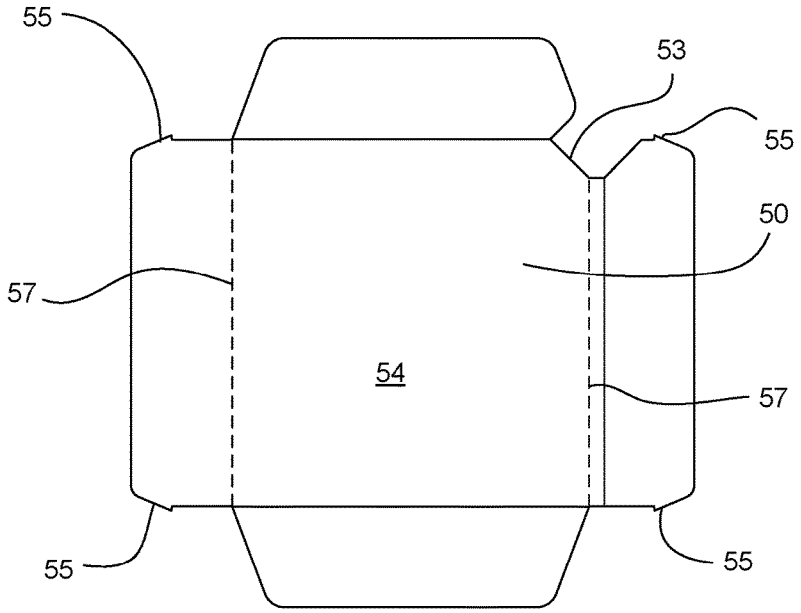
FIG. 15B is an example of the cover of FIG. 15A in the unfolded position.
Figure 16A:
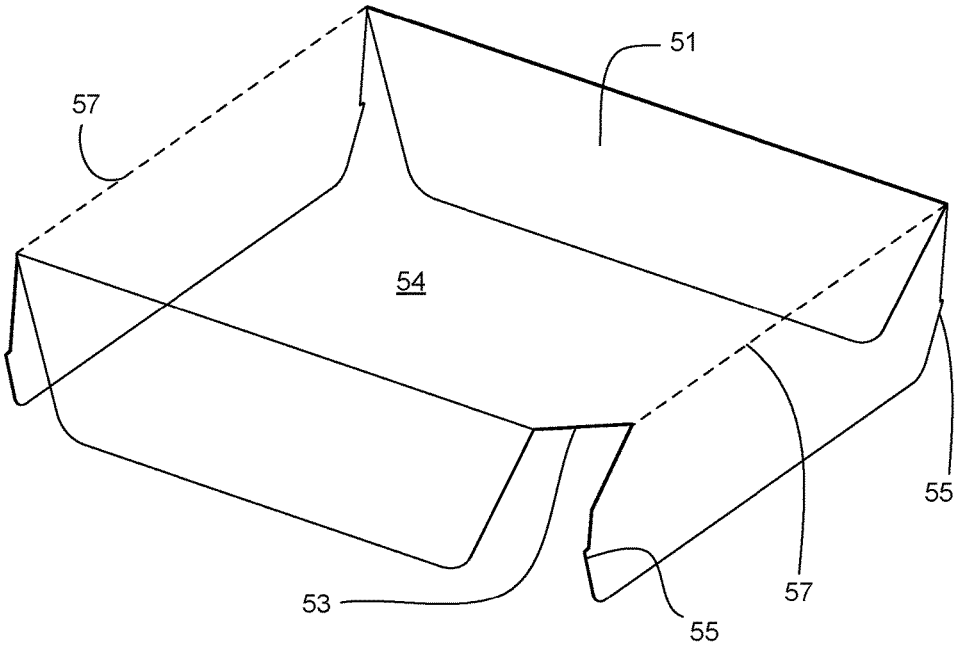
FIG. 16A is a perspective view of an example of a second transparent cover that may be provided as part of a system of packaging and displaying a set of products.
Figure 16B:
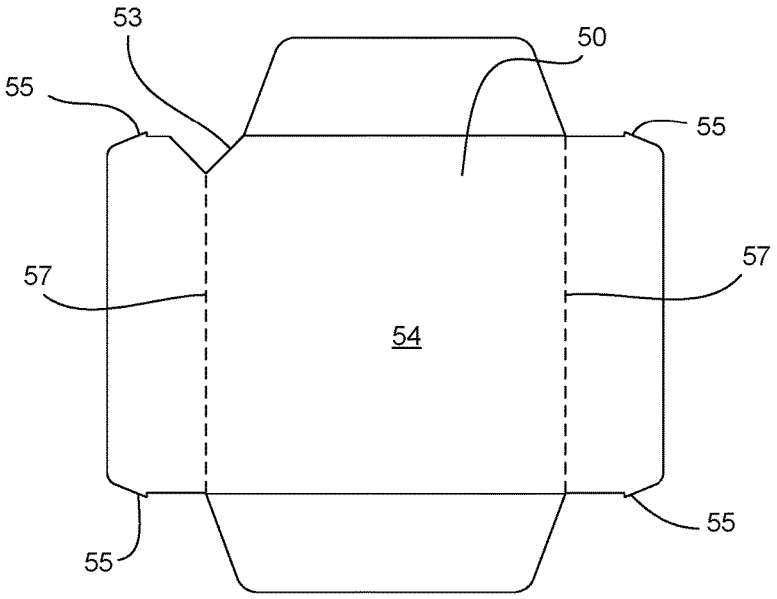
FIG. 16B is a view of an example of the cover of FIG. 16A in the unfolded position.

The box 40 may include a first transparent cover 50 provided on the display face of the container 41 (e.g., as shown in FIGS. 1 and 15A-15B) and a second transparent cover 51 provided on the display face of the container 42 (e.g., as shown in FIGS. 1 and 16A-16B). The covers 50, 51 may include top portions 54 made of or including a transparent, somewhat transparent, or translucent material to permit visible light to penetrate therethrough to display the products. In this way, when the box 50 is in the display position, a user can look at contents under the covers 50, 51. The top portions 54 may be of a suitable plastic or other such material.

The covers 50, 51 may have perforation lines 57 as shown in FIGS. 15A-16B. While shown as a set of two perforation lines 57, the perforation lines 57 may be connected by further perforations to form a single perforation line, or a perforation of some other shape, such as an arc, curve or a combination of shapes. The covers 50, 51 may also have grasping portions 53 that may be configured to facilitate grasping and pulling by a user so as to rip or tear the top portions 54 of the covers 50, 51 along the perforation lines 57 and thus provide access to the contents of the containers 41, 42. Each grasping portion 53 may be provided as a cutout as shown that allows a user to insert one or more fingers, may be a finger tab protruding from the top portion 54, or may be some other feature to allow convenient grasping by the user. All or a portion of each top portion 54 that lies between the perforation lines 57 may be made of a different material from remaining portions of the cover. For example, the portion between the perforation lines 57 may be made of transparent plastic or the like. The covers 50, 51, including side portions transverse to the top portions, may be one integral transparent plastic material, either clear or tinted. Also note that the perforation lines 57 may be formed at the folded edge of the cover, or inwardly from the folded edge, as shown in FIGS. 15A and 15B.

The covers 50, 51 may each further comprise side portions 56 for securing the cover to the respective container 40, 41. The side portions 56 may have barbs 55 to allow convenient assembly of the covers 50, 51 onto the containers 41, 42 and later product removal. When the covers 50, 51 are inserted in the containers 41,42, the barbs 55 are easily inserted in and become affixed in anchoring slits 71 of the inserts 70*a*, 70*b* or otherwise cooperate therewith (e.g., as shown in FIGS. 8A-9B). In addition, or in the alternative, the inserts 70*a*, 70*b* may be provided as part of or as attached to the containers 41, 42. The anchoring slits 71 may be provided instead, or in addition, in the containers 41, 42. When a user seeks access to the products in the box 40, the grasping portion 53 may be grasped and pulled, causing the top portion 54 to rip along the perforation lines 57, exposing the products. The side portions 56 of the cover 50, 51 having the barbs 55 may remain in the container, as the barbs 55 prevent their easy removal.

Also illustrated in FIG. 5 are electronic devices, such as the remote control devices 80, 81, that each have a supporting base 81*a* coupling to a remote control body 81*b* of the respective remote control devices 80, 81. The remote control devices 80, 81 may be, for example, hand-held remote controls. The supporting bases 81*a* may provide a means for allowing the remote control devices to rest on a surface, such as a table top, and may be removable from the remote control body 81*b* (e.g., which is the remote control itself). According to an aspect of the disclosure, the remote control body 81*b* may slide onto the supporting base 81*a*. Examples of remote control devices 80, 81 are described in greater detail in commonly-assigned U.S. Pat. No. 9,024,800, issued May 5, 2015, entitled WIRELESS BATTERY-POWERED REMOTE CONTROL HAVING MULTIPLE MOUNTING MEANS, the entire disclosure of which is hereby incorporated by reference.

Figure 10A:
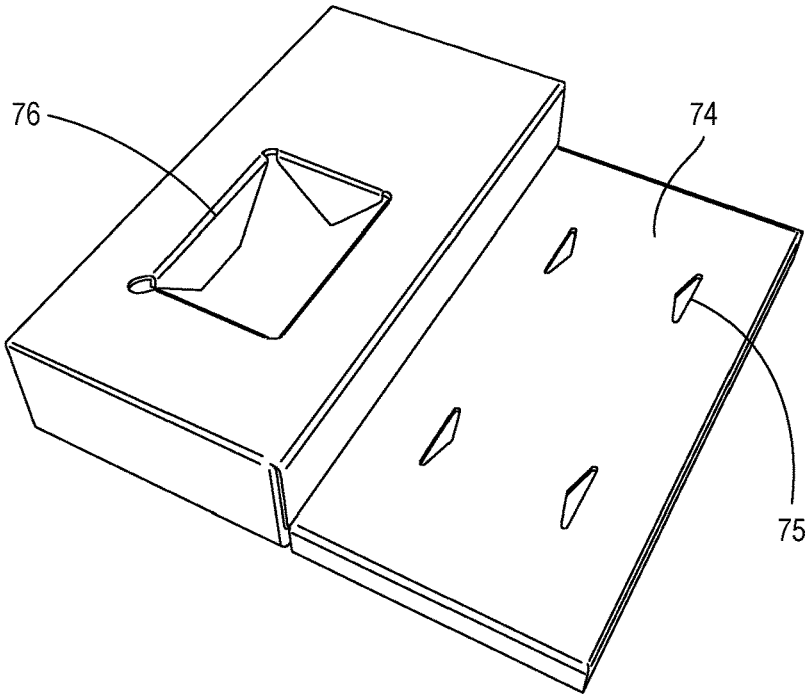
FIG. 10A is a view of an example of an anchoring insert of a system of packaging and displaying a set of products.
Figure 10B:
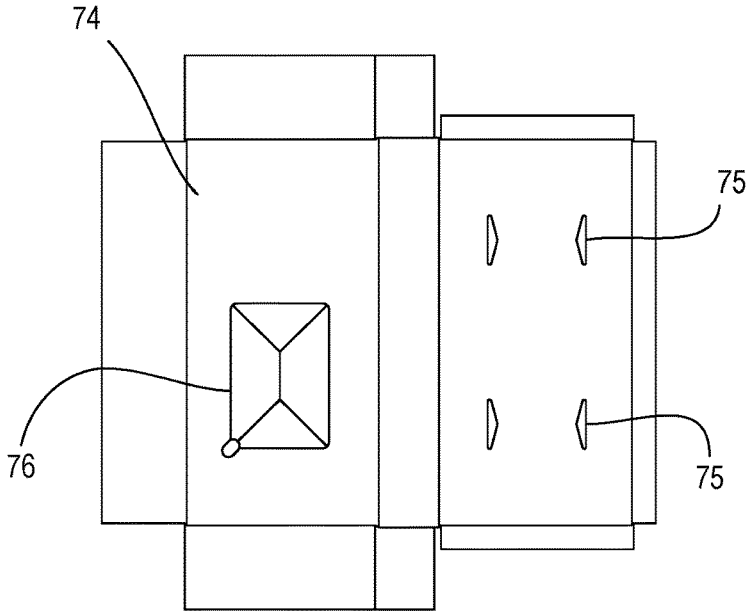
FIG. 10B is a view of an example of the anchoring insert in the unfolded position.
Figure 14A:
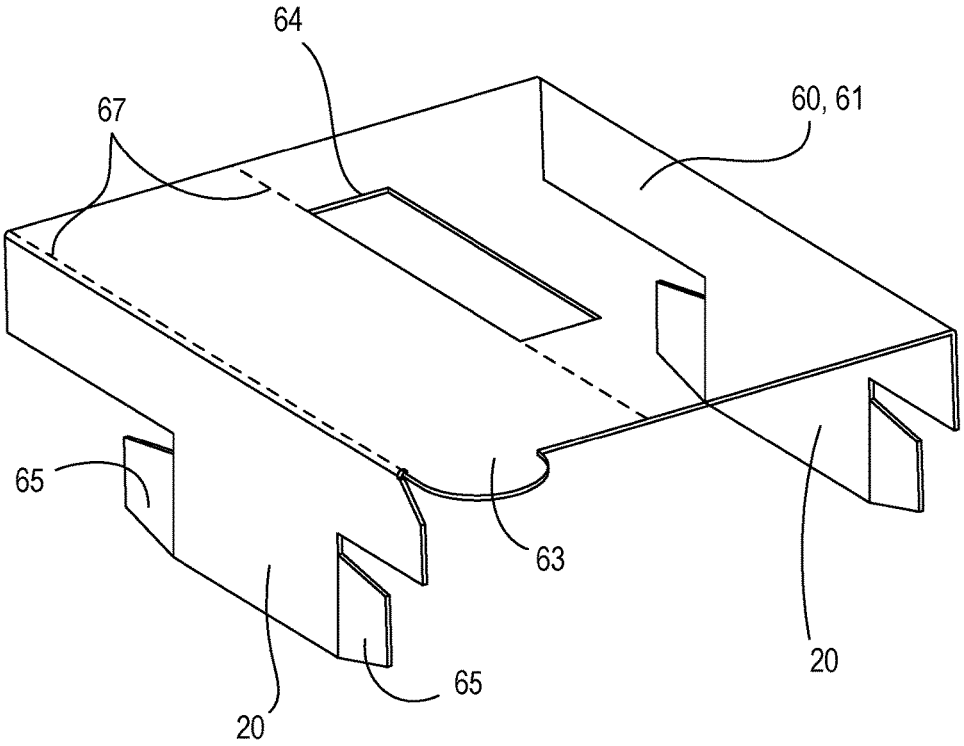
FIG. 14A is a perspective of an example of a strap that may be provided as part of a system of packaging and displaying a set of products.
Figure 14B:
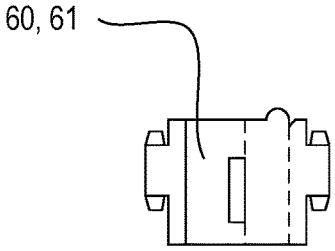
FIG. 14B is a view of an example of the strap of FIG. 14A in the unfolded position.

The remote control devices 80, 81 may be held in place by respective straps 60, 61 as illustrated in FIGS. 5 and 14A-14B. The straps 60, 61 may each contain apertures 64. The supporting base 81*a* may have an extending flanged part that protrudes out of the aperture 64 so that the remote control body 81*b* may then be slid onto the supporting base 81*a*. The straps 60, 61 may each include one or more catches 20 that have pairs of tabs 65 (e.g., as shown in FIG. 14A). The tabs 65 are insertable into respective apertures 75 in anchoring insert 74 (e.g., as illustrated in FIGS. 1 and 10A-10B) as a pair so as to secure the straps 60, 61 and remote control devices 80, 81 therein. In addition to or instead of the anchoring insert 74, the catches 20 may be secured in other structures of the container 42 or in the walls of the container 42 itself. As illustrated in FIGS. 14A-14B, such catches 20 may be provided on more than one side of the straps 60, 61. For example, the catches 20 may be provided on two sides, three sides or four sides. FIGS. 5 and 14A-14B illustrate two catches 20 per side. However, it will be understand that more or fewer than two catches 20 may be provided. In this way, the straps 60, 61 may be conveniently assembled with the system to secure the remote control devices 80, 81. Each catch 20 may include the pair of tabs 65, with each pair of tabs being received in the respective aperture 75. Typically, the straps 60, 61 may be made of a flexible, transparent plastic sheet material. The pairs of tabs 65 may be folded back on the strap sheet material, inserted through the aperture 75 in the anchoring insert 74 and then allowed to unfold at least partly so that the tabs are at least partly transverse to the sheet material, thus securing the strap 60, 61 and secured remote control device 80, 81 to the insert. The remote control device body 80*b*, 81*b* may be disposed above the respective strap 60, 61, with the supporting base 80*a*, 81*a* below the strap 60, 61. The two parts may connect to each other via the extending flanged part that protrudes through the aperture 64, and are thus secured in the container.

While the barbs 55 and the tabs 65 are shown to have a particular shape or configuration or dimensions, the tabs 65 in the straps 60, 61 and the barbs 55 provided on the covers 50, 51 may have additional shapes or alternate dimensions and configurations provided they secure into and cooperate with the apertures of the respective anchoring structure. Further, the shape, configuration and dimensions of the barbs 55 and the tabs 65 need not be identical to other barbs and tabs on the same or on any structure. According to an aspect of the disclosure, other securing means, such as adhesive, tape, glue, stapling or other affixing means may be provided in addition to, or instead of, the barbs and/or tabs of any of the structures disclosed herein. Also, the straps 60, 61 and/or the covers 50, 51 may be provided integrally with the structure or with the container into which they are to be anchored or secured so as to secure the device thereby.

The straps 60, 61 may include perforation lines, e.g., two perforation lines 67, as shown in FIGS. 14A-14B. However, the perforation lines 67 may be connected by additional perforations to form a single perforation line, curve or arc or the like, or other shape, or a combination of the foregoing perforations may be provided. The top portion 54 of the straps 60, 61 may be made of a see-through, transparent or translucent material. Strap 61 may be identical to strap 60, or may be different in one or more aspect herein discussed from strap 60.

Where the remote control device 80, 81 are secured by the strap 60, 61, the extending flanged parts of the supporting bases 80*a*, 81*a* may extend out of the respective apertures 64, as shown in FIG. 1. The remote control devices 80, 81 may be securely held in the anchoring insert 74. Because of the transparency of straps 60, 61, the supporting bases 80*a*, 81*s* are visible.

Figure 6:
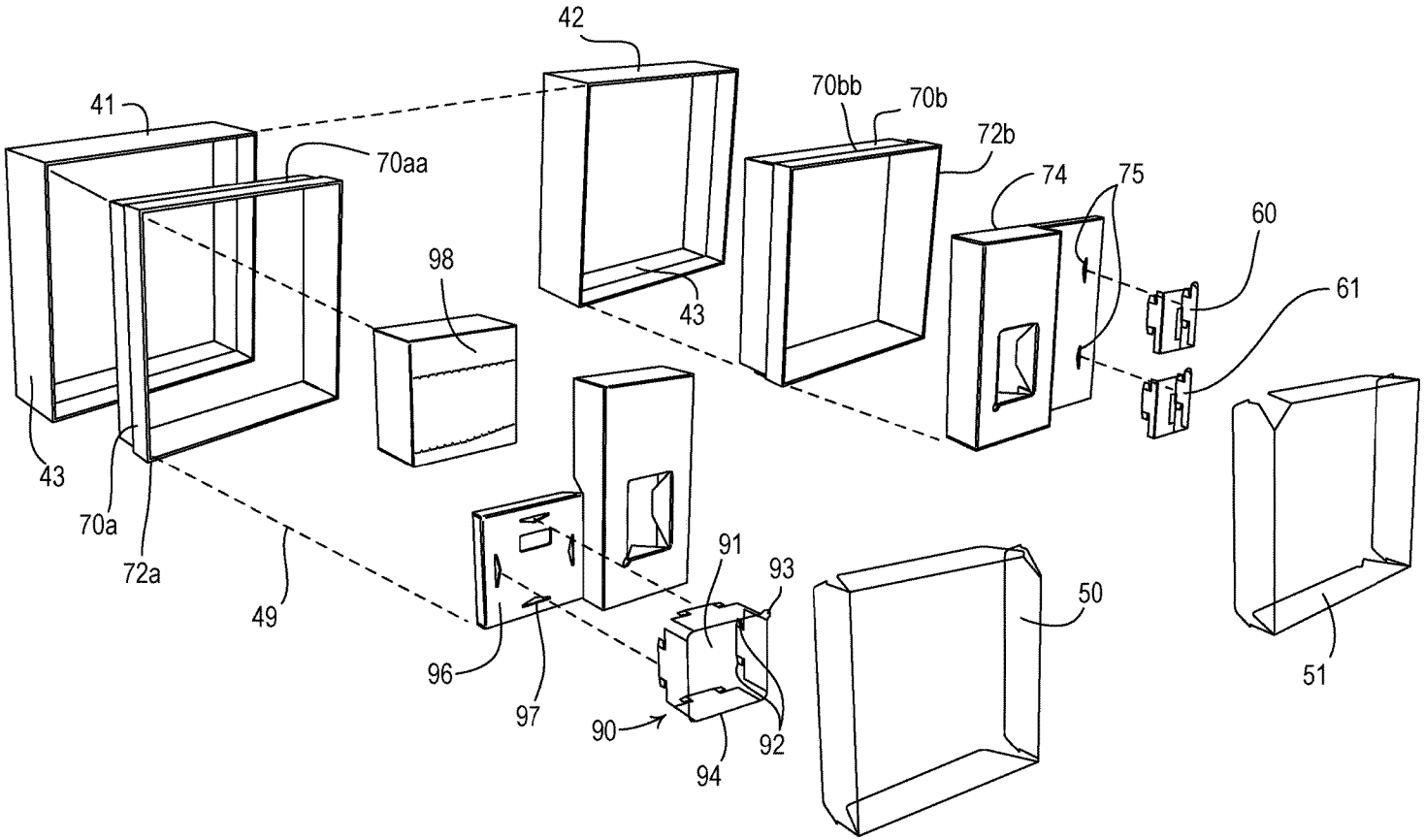
FIG. 6 is an exploded view of the system of packaging and displaying products of FIG. 1 that omits the products.

The second cover 51 for the container 42 (e.g., as illustrated in FIGS. 5 and 6) may have one or more features, or all features, similar to the cover 50. The second strap 61 (e.g., as illustrated in FIGS. 5 and 6) may have one or more features, or all features, similar to those of the strap 60 for a second electronic device, such as the remote control device 81. For example, the straps 60, 61 may each secure an electronic device that includes a base with a protruding portion, as illustrated (e.g., the remote control devices 80, 81).

The strap 60 may include a grasping member 63, as illustrated in FIG. 14A. The grasping member 63 may be a finger tab protruding from near the top face of the straps 60, 61, or the grasping member 63 may be a cutout to facilitate insertion of a finger or the like of the user to make it more convenient to grasp and pull a portion of the straps 60, 61 so as to tear or rip along the perforation lines 67 to free or release the remote control device 80, 81 held in place by the respective strap 60, 61. The portions of straps 60, 61 positioned between the perforation lines 67 may be made from material different from the remaining portions of straps 60, 61. For example, the portions between the perforation lines 67 may be made of a see-through, semi-transparent, transparent or translucent material that permits visible light to pass, for example, a plastic material, whereas the rest may be made of paper, cardboard, cardstock or a combination of the foregoing. Similarly, the containers 41, 42 and other structures herein discussed, may be made of a product such as paper, cardboard, cardstock, plastic, or the like, a combination of the foregoing or any other suitable material. The perforation lines 57 and 67 may be positioned elsewhere along their respective structures. The straps 60, 61 may be made of a single transparent plastic material. When the grasping portion 63 is grasped to tear the perforation lines, the electronic product can be removed from the container. The portions of the straps 60, 61 bearing the tabs 65 remain affixed to the anchoring insert 74 in the container.

As previously mentioned, the anchoring member 74 includes the apertures 75 that receive or cooperate with the tabs 65 provided in the straps 60, 61 with two tabs 65 in each aperture 75 as shown in FIGS. 1 and 10A-10B. Separate anchoring members 74 may be provided for each strap 60, 61, or, as illustrated in FIGS. 5 and 6, a single anchoring member 74 may be provided with multiple apertures 75 that receive tabs or cooperate with tabs of both straps 60, 61.

Several figures of the drawings illustrate configurations of the structures shown in an unfolded state prior to assembly. It will be understood that these illustrations are provided merely by way of illustrative example and in no way limit the scope of the disclosure.

Figure 11A:
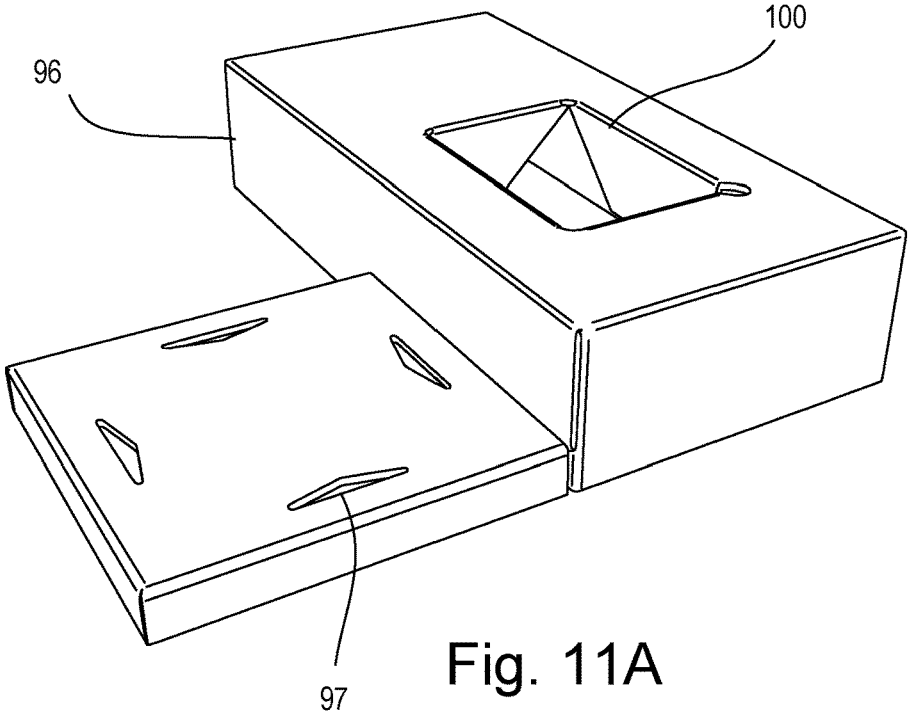
FIG. 11A is a perspective view of an example of an anchoring insert of a system of packaging and displaying a set of products, the anchoring insert for securing two electronic products.
Figure 11B:
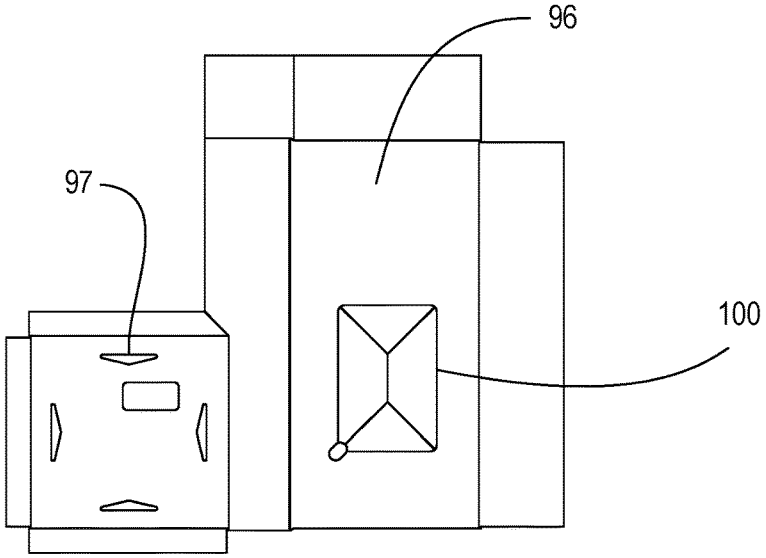
FIG. 11B is a view of an example of the anchoring insert of FIG. 11A when the anchoring insert is in the unfolded position.
Figure 13A:
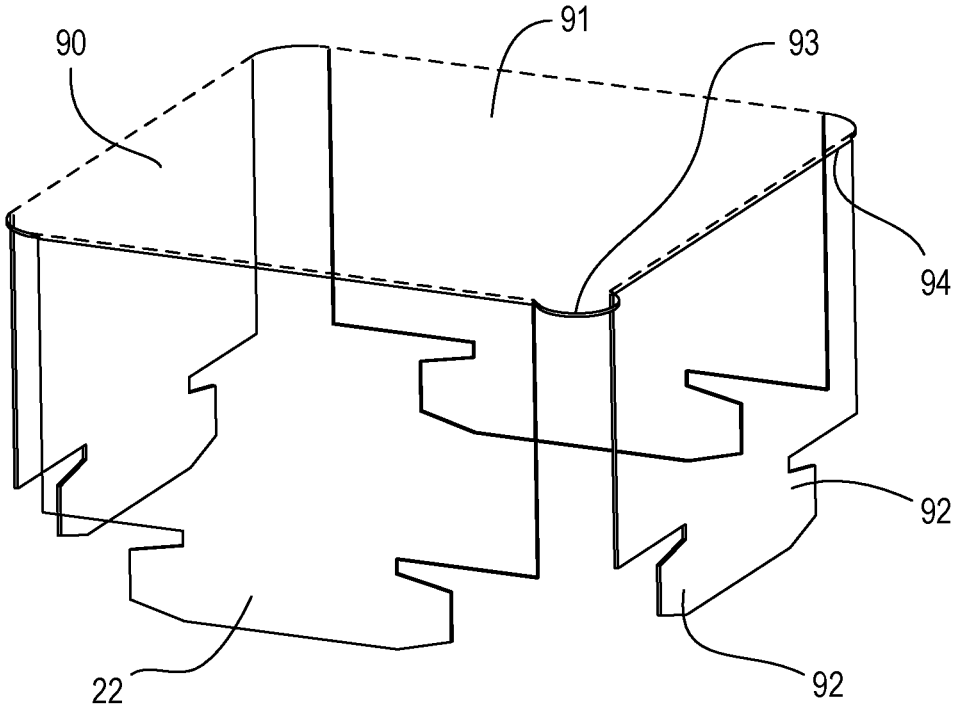
FIG. 13A is a perspective view of an example of a strap member that may be provided as part of a system of packaging and displaying a set of products, and in particular for securing one of the electronic products to the anchoring insert of FIG. 11A.
Figure 13B:
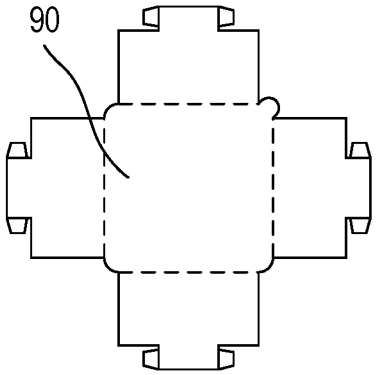
FIG. 13B is a view of an example of the strap member of FIG. 13A in the unfolded position.

An anchoring insert 96 may include apertures or recesses 97 (e.g., as illustrated in FIGS. 11A and 11B) that each may receive pairs of tab members 92 of a strap member 90 (e.g., as illustrated in FIGS. 13A-13B). Together with the anchoring insert 96, the strap member 90 may thus secure an electronic device, such as the wireless bridge 95. The strap member 90 may include a grasping member 93. For example, the grasping member 93 may be a finger tab protruding from near the top face of the strap member 90 or the grasping member 93 may be a cutout to facilitate insertion of a finger or the like of the user to make it more convenient to grasp and pull a top portion 91 of the strap member 90 so as to tear or rip perforation lines 94 to remove the top portion 91 of the strap member 90 and thus to free or to release the wireless bridge 95 underneath. A catch member 22 may include two tab members 92, with the tab members 92 of the catch member 22 oriented in opposite directions so as to face away from each other. The two tabs members 92 may be received in each slot 97. However, each tab member 92 may be received in its own slot, and more than two tab members may be received in the same slot.

The portion 91 of the strap member 90 defined by the perforation lines 94 may be made from material different from the remaining portions of the strap member 90. For example, the portion 91 defined by the perforation lines 94 may be made of a see-through, semi-transparent, transparent or translucent material that permits visible light to pass, for example, a plastic material, whereas the rest may be made of paper, cardboard, cardstock, plastic, or a combination of the foregoing. The member 90 may be a one piece integral flexible transparent plastic sheet member, folded as shown. The catch portion 20 of the straps 60, 61 with the tab 65, the catch member portion 22 of the strap member 90, and the portion of cover 50, 51 with barbs 55 may be made of a material different, for example plastic, vinyl or the like, from remaining portions of strap 60, 61 and, respectively, of cover 50, 51.

The anchoring inserts 74 and 96 may also include suitable cut-outs 76, 100, into which respective electronic products, e.g., the dimmers 84, may be recessed. When the transparent covers 50, 51 are opened by tearing the respective perforations, the dimmers 84 can be accessed by the user.

Note that after the perforations 57 of the covers 50 and 51 are torn, providing access to the electronic products, the parts of the covers 50 and 51 with the barbs 55 remain attached to the containers 41, 42 because the barbs 55, although permitting easy assembly of the covers into containers 41, 42, do not permit easy removal. The barbs 55 may be one way barbs, permitting easy insertion but not removal.

Figure 12A:
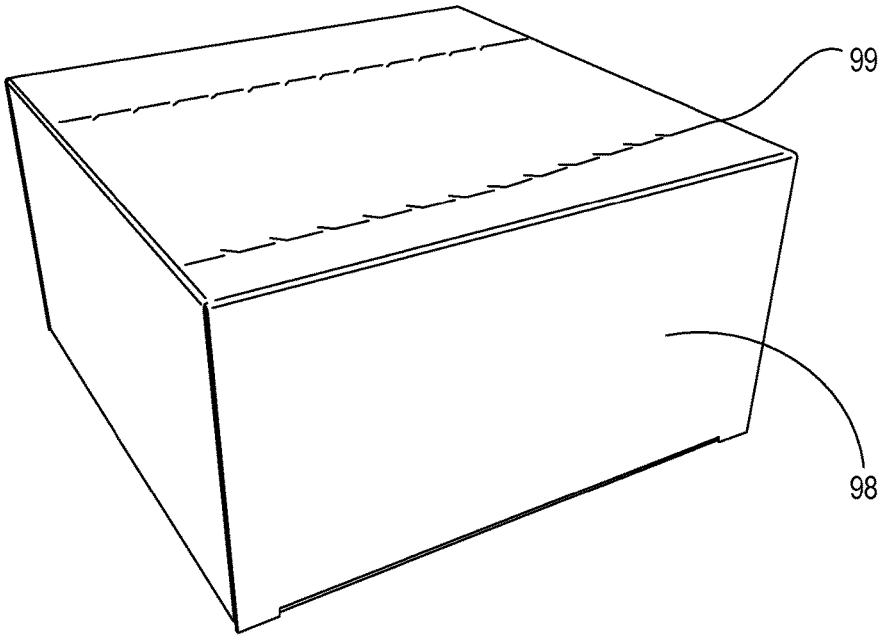
FIG. 12A is a perspective view of an example of a utility box for storing accessory components that is part of a system of packaging and displaying a set of products.
Figure 12B:
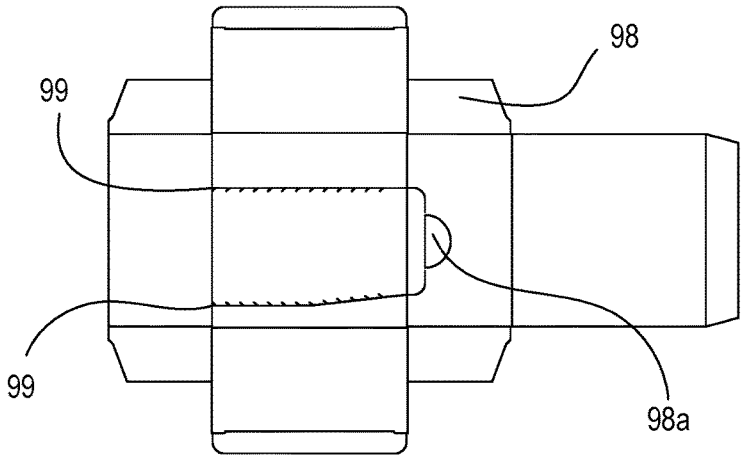
FIG. 12B is a view of the utility box of FIG. 12A in the unfolded position.

The utility box 98 may store various accessories, such as electrical cables, power cords, chargers, batteries, plugs, instruction manuals, warranties, and the like, or a combination of one or more of the foregoing. According to an alternative arrangement, the anchoring insert 96 may also secure in place the utility box 98. The utility box 98 may include one or more perforation lines 99 (e.g., as shown in FIGS. 12A and 12B), which may be connected by additional perforations to form a single perforation line, curve or arc or the like, or other shape, or a combination of the foregoing perforations may be provided. In this way, a convenient way to open the utility box 98 may be provided. The utility box 98 may be made of paper, cardboard, papier-mâché, plastic, or a combination of the foregoing. The utility box 98 may be exposed for removal once the perforations of cover 50 are torn. The utility box 98 may include a suitable grasping portion 98*a* to facilitate ripping the perforations 99.

The anchoring inserts 96 and 74 may each suitably secured in respective containers 41, 42 by suitable means, adhesive, stapling, etc. and/or by snugly fitting inside the respective insert 70*a*, 70*b* or the container 41, 42.

The products contained in the box 40 may be positioned such that a first product that logically or typically is to be installed first is positioned more prominently in the containers 41, 42 from the perspective of the user. Display or viewing direction 49 may be a direction from which the user typically uses the contents of the container 41, 42 from the first display face of the containers 41, 42. The second product that logically or typically is to be used or installed by the user may be positioned adjacent the first product, and the next product adjacent the second product and so on. In this way, according to an aspect of the disclosure, the containers 41, 42 together may thus organize or arrange the set of products for the user and may thus aid the user in using, removing, and installing/deploying the set of products. For example, the products may be positioned from left to right, the typical direction of reading by most users. Accordingly, the products may be packaged so that the utility box 98 containing instructions and accessories is on the left top (in the container 41), followed by the wireless bridge 95 (in the container 41), a first one of the dimmers 84 (in the container 41), a second one of the dimmers 84 (in the container 42), and the two remote control devices 80, 81 (in the container 42). This would be the normal order of removal and installation from the packaging. One or more parts of the box 50 (e.g., the utility box 98 and/or the anchoring inserts 74, 96) may have markings to assist the user in removal and installation of the products. For example, as shown in FIG. 4, the utility box 98 and the anchoring inserts 74, 96 may have numbers 86 and text 88 (e.g., simple instructions) for guiding the user through the removal and installation process. The ordering is thus intuitive and the user retrieves the products in the order of assembly and installation, starting with the instructions in the utility box 98.

The present invention has been described in relation to particular embodiments thereof. However, many other variations and modifications and other uses will become apparent to those skilled in the art. Also, one or more features recited with respect to one structure may be provided as feature/s in addition to, or instead of, for a different structure, and combinations of features for any given structure other than those enumerated are also contemplated. Not all features discussed with respect to any given structure may necessarily be provided in all embodiments. It is preferred, therefore, that the present invention be limited not by the specific disclosure herein, but only by the appended claims.

What is claimed is:

1. A system of packaging and displaying a set of products, the system comprising:

a box having a first container and a second container, the first container comprising a first display face, and a first back positioned on a side of the container opposite the first display face, the second container comprising a second display face, and a second back positioned on a side of the second container opposite the second display face, the first and second containers being hingedly connected to allow the box to change from a closed position to an open position, the first and second display faces being oriented to be open toward a first direction in the open position; and a cover configured to close off the first display face of the first container and to secure in the first container a displayed product of the set of products, the displayed product visible through the cover, the cover comprising at least one side portion for securing the cover to the first container and at least one first tear perforation positioned more proximal to the display face than the side portion, the cover further comprising a grasping portion configured to be manually grasped and pulled, the at least one tear perforation configured to be torn when the grasping portion is manually pulled, so as to provide access without tools to the displayed product in the first container;

wherein the products of the set of products in the first and second containers are arranged in an order of use and installation of the products.

2. The system of claim 1, wherein the first container comprises:

a first strap having an aperture and configured to secure in the first container a protruding product of the set of products, the protruding product having a portion protruding through the aperture and the strap comprising:

a first catch received in the first container and securing the first strap and the protruding product in the first container;

at least one first strap tear perforation positioned more proximal to the first display face than the first catch; and a grasping portion comprising at least one of a finger tab extending from the first strap and a recess area, the grasping portion configured to be manually grasped and pulled, and the at least one first strap tear perforation is configured to be torn, when the grasping portion is manually pulled, so as to release the protruding product without tools, the protruding strap being at least partly transparent so that the first product is at least partly visible through the first strap.

3. The system of claim 2, wherein the first catch comprises a first tab and a second tab oriented away from the first tab, the first and second tabs being received in a same aperture of the first container.

4. The system of claim 2, wherein the at least one first strap tear perforation comprises a first strap first tear perforation and a first strap second tear perforation without perforated connection therebetween.

5. The system of claim 2, wherein the first strap further comprises:

a second catch comprising a third tab and a fourth tab oriented away from the third tab, the third tab oriented in substantially the same direction as the first tab and the fourth tab oriented in substantially the same direction as the second tab, wherein the third and fourth tabs project from a side of the first strap opposite the first and second tabs, and are positioned and configured to secure the first strap.

6. The system of claim 2, further comprising an anchoring insert having apertures configured to receive the catch of the first strap and to secure thereby the first strap and the protruding product.

7. The system of claim 1, further comprising a strap member comprising:

a first catch member securing the strap member in one of the first container and the second container;

at least one strap member tear perforation positioned more proximal to the display face than the first catch member; and a grasping portion configured to be manually grasped and pulled, and the at least one tear perforation configured to be torn, when the grasping portion is manually pulled, so as to release without use of tools an electronic device of the set of products, the strap member being at least in part transparent such that the electronic device is at least partly visible through the strap member.

8. The system of claim 7, wherein one of the first and second containers comprises an anchoring insert having apertures configured to receive the first catch member of the strap member, such that the strap member and the anchoring insert cooperate to secure therebetween the electronic device.

9. The system of claim 8, wherein the anchoring insert has a recess configured to receive a further electronic device.

10. The system of claim 1, wherein one of the first and second containers comprises a lip extending in the first direction, and another of the first and second containers comprises a recessed edge positioned such that in the closed position, the recessed edge and lip cooperate to facilitate closure of the box.

11. The system of claim 10, wherein the first container has outer dimensions substantially equal to outer dimensions of the second container, exclusive of the lip.

12. The system of claim 10, further comprising:

a first insert configured to be positioned immediately inside the first container, and further comprising a second insert configured to be positioned immediately inside the second container, wherein one of the first and second inserts comprises the lip, and the other of the first and second inserts comprises the recessed edge.

13. The system of claim 1, wherein one of the first and second containers comprises a first magnetic element, and another of the first and second containers comprises a second element positioned and configured to be magnetically attracted to the first magnetic element, the first magnetic element and the second element assisting closure of the box to the closed position.

14. The system of claim 13, wherein the first and second containers each comprise:

a side portion positioned transverse to the display face and configured to support the respective container in a standing position transverse to a lying position in which the respective container rests on the back of the container;

wherein each side portion comprises at least one notch sized and configured to hold at least one of the first magnetic element and the second element.

15. The system of claim 1, wherein in the open position, when placed on the first and second backs, the first container and the second container lie flat and the first and second display faces face up.

16. The system of claim 1, wherein the at least one tear perforation comprises a first tear perforation and a second tear perforation without perforated connection therebetween.

17. The system of claim 1, wherein the first and second containers are configured to arrange the set of products such that a first product of the set of products designed to be deployed in use by a user ahead of all remaining products of the set of products is accessible first by the user in the first and second containers, and a second product of the set of products designed to be deployed in use by a user after the first product is positioned adjacent the first product with no intervening products positioned between the first and second products.

18. A system of packaging and displaying a set of products, the system comprising:

a box having a first container and a second container, the first container comprising a first display face and a first back positioned on a side of the container opposite the first display face, the second container comprising a second display face and a second back positioned on a side of the second container opposite the second display face, one of the first and second containers comprising a first magnetic element, and another of the first and second containers comprising a second element positioned and configured to be magnetically attracted to the first magnetic element, the first and second containers being hingedly connected to allow the box to change from a closed position to an open position, the first magnetic element and the second element assisting closure of the box to the closed position, the first and second display faces are oriented to be open toward a first direction in the open position;

a first cover configured to close off the first display face of the first container and to secure in the first container a first displayed product of the set of products, the displayed product visible through the first cover, the first cover comprising a first side portion for securing the first cover to the first container and at least one tear perforation positioned more proximal to the display face than the first side portion, the first cover further comprising a grasping portion comprising at least one of a finger tab extending from the first cover and a recess area, the grasping portion configured to be manually grasped and pulled, and the at least one tear perforations configured to be torn, when the grasping portion is manually pulled, so as to provide access without tools to the first displayed product; and a strap member comprising a catch member securing the strap member in one of the first container and the second container, and at least one strap member tear perforation positioned more proximal to the display face than the catch member, the strap member further comprising a grasping portion configured to be manually grasped and pulled, and the at least one tear perforation configured to be torn, when the grasping portion is manually pulled, so as to release without use of tools an electronic device of the set of products, the strap member being at least in part transparent such that the electronic device is at least partly visible through the strap member; and an anchoring insert having apertures configured to receive the catch and to secure thereby the first strap and the protruding product.

19. The system of claim 18, further comprising a second cover configured to close off the second display face of the second container and to secure in the second container a second displayed product of the set of products, the second displayed product visible through the second cover, the second cover comprising a second side portion for securing the second cover to the second container and at least one second tear perforation positioned more proximal to the display face than the second side portion, the second cover further comprising a grasping portion comprising at least one of a finger tab extending from the second cover and a recess area, the grasping portion configured to be manually grasped and pulled, and the at least one tear perforation configured to be torn, when the grasping portion is manually pulled, so as to release the second displayed product without tools.

* * * * *